US006039195A

United States Patent [19]

Konefal et al.

[11] Patent Number: 6,039,195

[45] Date of Patent: Mar. 21, 2000

[54] CHILD RESISTANT PACKAGE

[75] Inventors: Robert S. Konefal, Wilton Centre, N.H.; Noel T. Vander, Berlin, Ohio

[73] Assignee: Owens-Brockway Prescription Products Inc., Toledo, Ohio

[21] Appl. No.: 09/210,195

[22] Filed: Dec. 11, 1998

Related U.S. Application Data

[62] Division of application No. 08/982,996, Dec. 2, 1997, Pat. No. 5,899,348.

[51] Int. Cl.[7] ..... B65D 50/08

[52] U.S. Cl. ..... 215/209; 215/225; 215/321; 220/281

[58] Field of Search ..... 220/281, 791, 220/793; 215/43, 224, 225, 321, 216, 209

[56] References Cited

U.S. PATENT DOCUMENTS

| | | | |
|---|---|---|---|
| 2,532,729 | 12/1950 | Millstein . | |
| 3,700,133 | 10/1972 | Bagguley . | |
| 3,744,655 | 7/1973 | Nixdorff, Jr. . | |
| 3,884,379 | 5/1975 | Landen . | |
| 3,892,326 | 7/1975 | Schneible . | |
| 3,902,620 | 9/1975 | McIntosh . | |
| 3,939,788 | 2/1976 | Schneible . | |
| 3,944,101 | 3/1976 | Landen et al. . | |
| 4,036,385 | 7/1977 | Morris . | |
| 4,099,639 | 7/1978 | Boxer et al. . | |
| 4,103,797 | 8/1978 | Morris . | |
| 4,241,856 | 12/1980 | Otterson . | |
| 4,326,649 | 4/1982 | Marino et al. | 220/281 |
| 4,365,721 | 12/1982 | Montgomery . | |
| 4,427,124 | 1/1984 | Marshall et al. . | |
| 4,464,316 | 8/1984 | Michaels . | |
| 4,630,743 | 12/1986 | Wright . | |
| 4,687,112 | 8/1987 | Swartzbaugh | 215/216 |
| 4,948,002 | 8/1990 | Thornock et al. . | |
| 5,145,080 | 9/1992 | Imbery, Jr. . | |
| 5,184,741 | 2/1993 | Chevassus et al. . | |
| 5,197,617 | 3/1993 | Edwards . | |
| 5,265,751 | 11/1993 | Lima et al. . | |
| 5,307,945 | 5/1994 | Hidding et al. . | |
| 5,307,946 | 5/1994 | Molinaro . | |
| 5,381,911 | 1/1995 | Teicher et al. . | |
| 5,413,233 | 5/1995 | Hall . | |
| 5,544,768 | 8/1996 | Gargione | 215/216 |

*Primary Examiner*—Allan N. Shoap
*Assistant Examiner*—Joe Merek

[57] ABSTRACT

A child resistant package which includes a container having an open end and multiple threads on the external surface of the container adjacent the upper end. A closure having a base wall and a peripheral skirt has an inner surface formed with single or multiple threads corresponding in number to the multiple threads on the container for engaging the threads on the container. A deflectable release element is formed integrally on the container. The release element includes an integral axially deflectable lug extending upwardly toward the open end of the container. The closure has at least one locking lug on the skirt of the closure, the number of locking lugs preferably corresponding to the number of threads on the container and closure. The deflectable lug on the deflectable release element normally extends upwardly for engagement with the locking lug such that when the release element is pressed radially inwardly, the lug is disengaged from engagement with a locking lug and the closure can be removed by unthreading the closure from the container. When the closure is reapplied minimal torque is required due to the axial deflection of the lug and one of the stops on the closure moves past the lug. In a preferred form of the child resistant package, the deflectable release element and container include interengaging stops to limit the deflection on the release element.

13 Claims, 10 Drawing Sheets

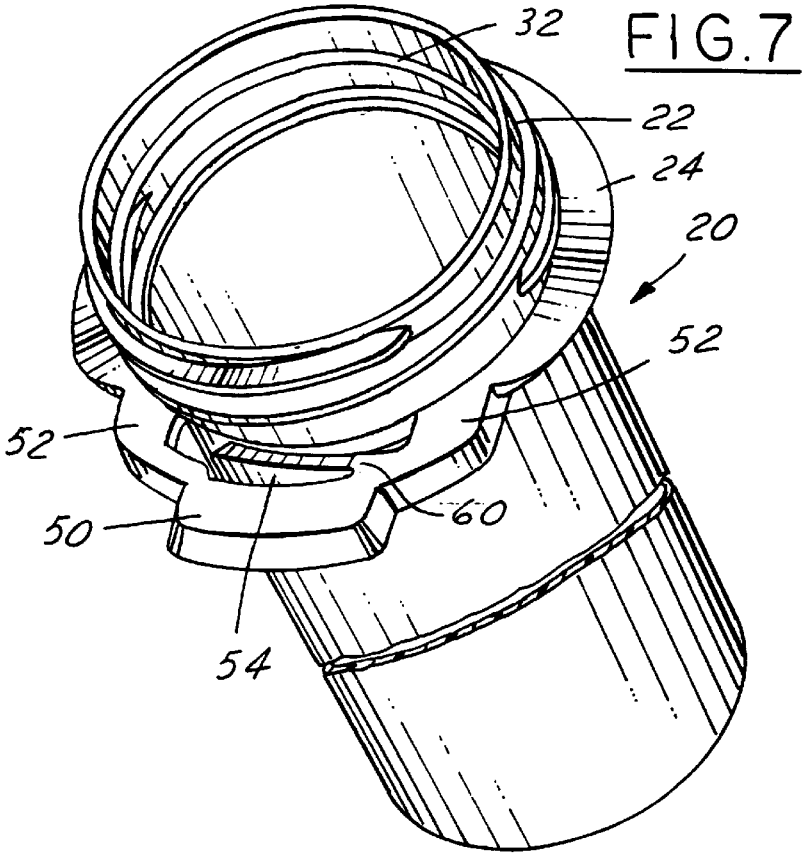
FIG.7
FIG.8
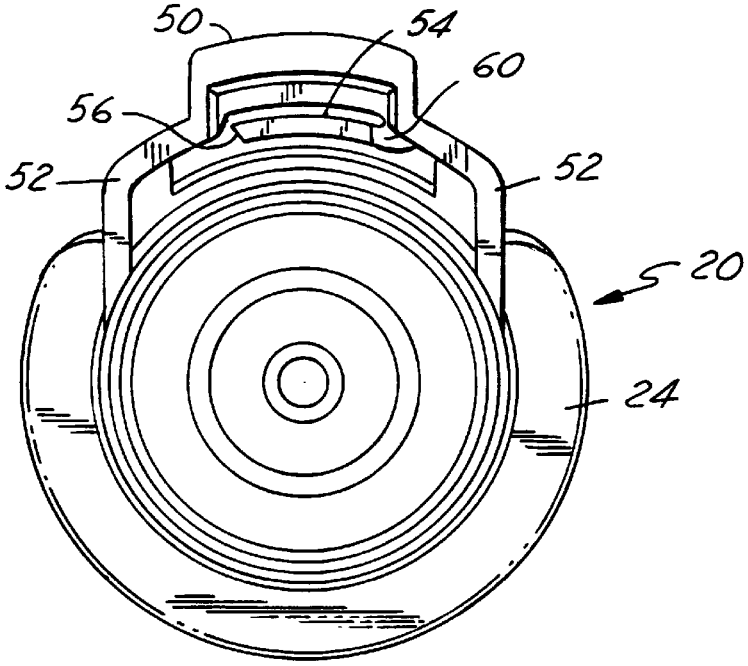

FIG.10
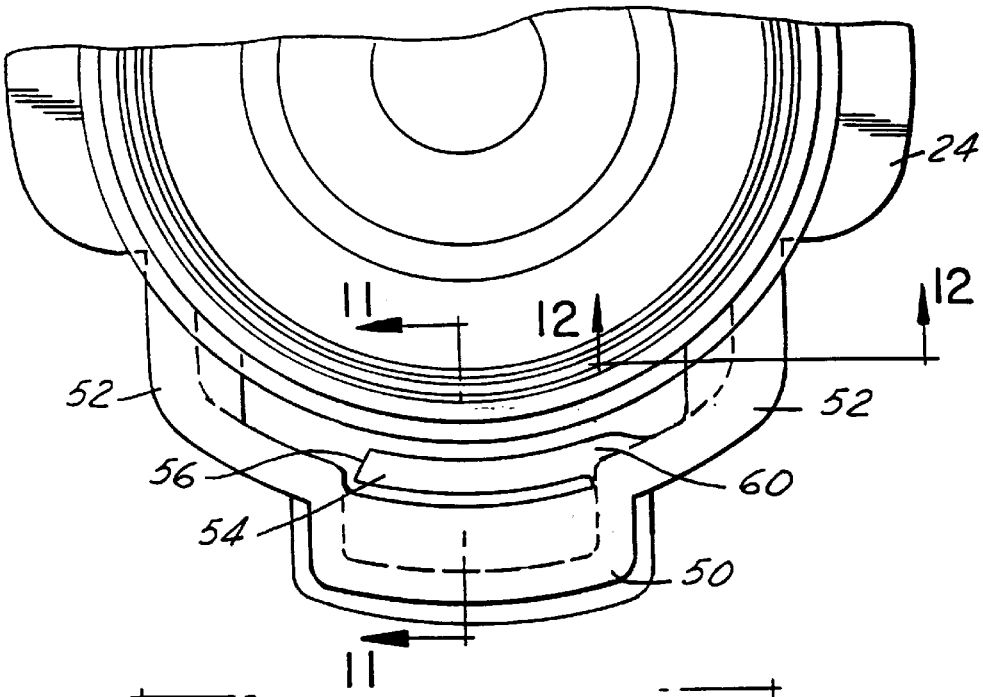
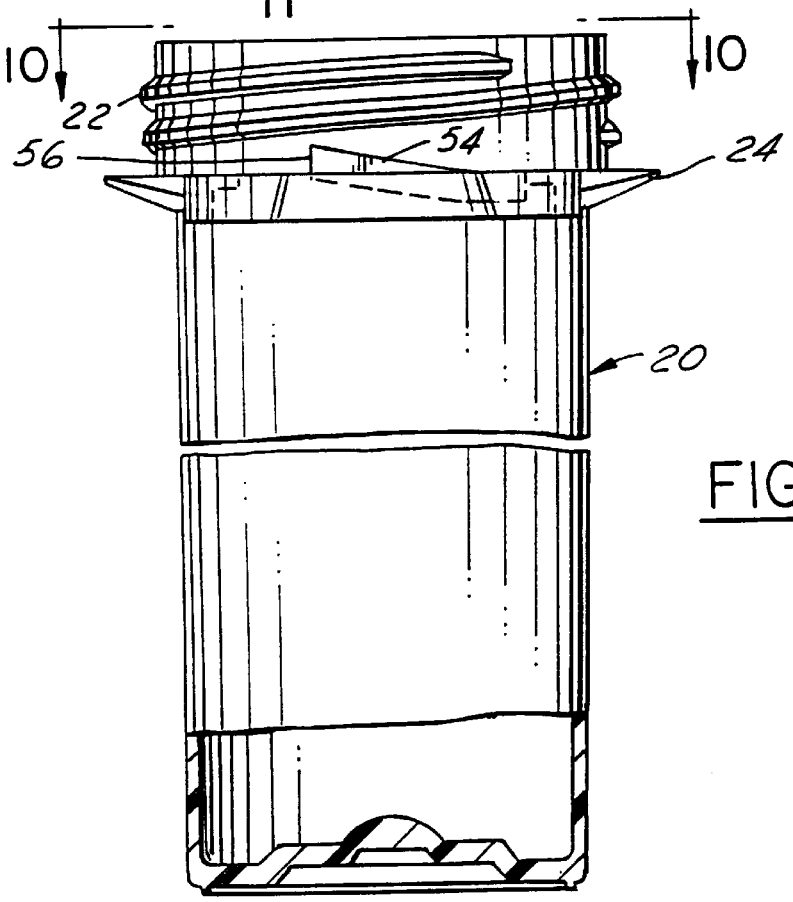
FIG.9

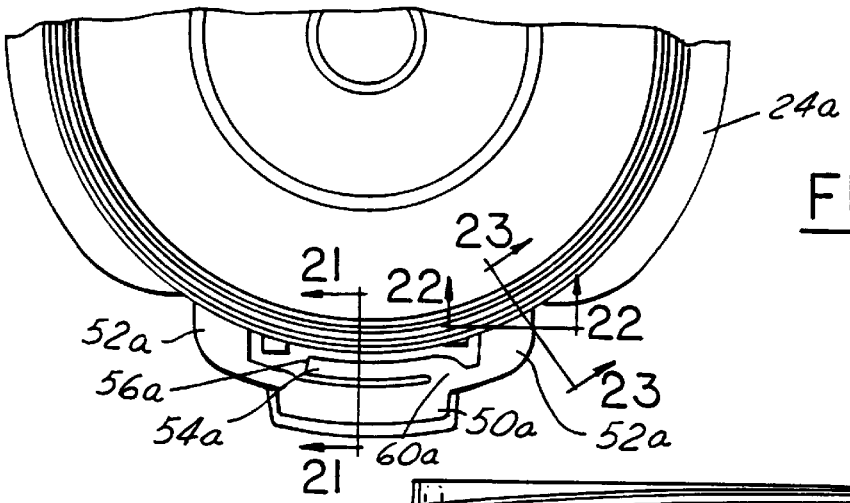
FIG.18
FIG.19
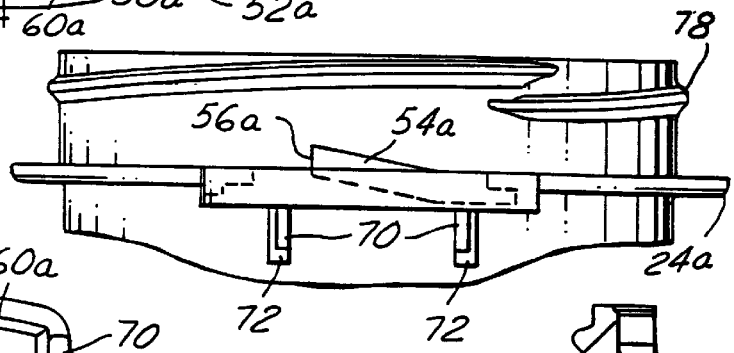
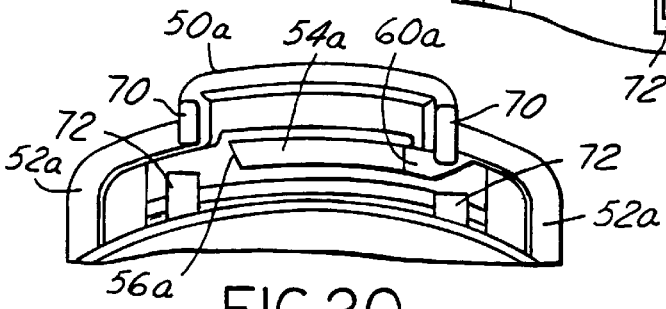
FIG.20
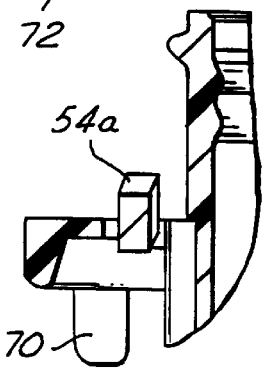
FIG.21
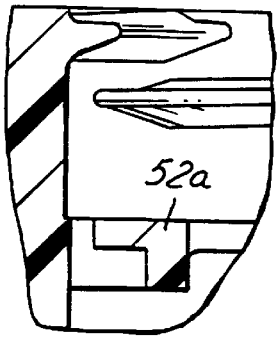
FIG.22
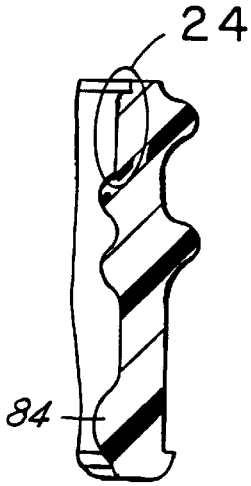
FIG.23
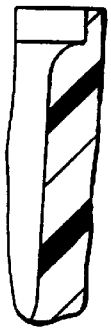
FIG.24

CHILD RESISTANT PACKAGE

This application is a division of application Ser. No. 08/982,996 filed Dec. 2, 1997, now U.S. Pat. No. 5,899,348.

BACKGROUND AND SUMMARY OF THE INVENTION

Child resistant packages for medicine and poison containers have been devised in the prior art for the protection of young children. Among the prior art types of safety closures are those which involve the ratcheting engagement of teeth on a container screw cap with a yielding locking element or tooth on the container neck or body portion, the container locking tooth responding to a downward manual pressure to effect release of the closure of the child resistant package. Examples of such prior art type of cap are contained in U.S. Pat. Nos. 3,700,133; 3.884,379; 3,892,326 and 3,902,620. Other types of packages have radially deflectable lugs as shown in U.S. Pat. Nos. 4,427,124; 4,984,002 and 5,413,233.

It is also known in the prior art to provide a child resistant package in which a movable release element on the closure responds to lateral or side pressure to free the cap from interlocking engagement with teeth or other like projection means on the container. In U.S. Pat. No. 4,036,385, the child resistant package consists of a container body having a yielding resilient manually operable release element positioned on the side wall of the container near the end thereof which receives a screw-threaded closure. The release element carries a single upstanding locking lug which is capable of ratcheting to interlocking engagement with a locking lug on a bottom skirt member of the threaded cap during rotation of the closure to gradually tighten it down on the threaded portion of the container. The release element responds to pressure applied by the thumb at one side of the container to shift the lug of the release element inwardly on a substantially radial path relative to the axis of the container and container closure. This movement separates the lug on the release element from the locking lug of the threaded closure so that the closure may be removed by simple rotation. The arrangement presents a complex manipulation necessary to effect release of the cap which achieves the result of making it difficult for small children to operate.

U.S. patent application Ser. No. 08/608,877 filed Feb. 29, 1996, now U.S. Pat. No. 5,711,442 (OI Docket No. 16766) discloses a child resistant package including a container having an open end and multiple threads on an external surface of the container adjacent the upper end. A closure having a base wall and a peripheral skirt has an inner surface formed with multiple threads corresponding in number to the multiple threads on the container for engaging the threads on the container. A release element is formed integrally on the exterior surface of the container below the threads. The release element includes an integral axial lug extending upwardly toward the open end of the container. The closure has a plurality of circumferentially spaced stops on the inner surface of the skirt of the closure below the threads corresponding in number to the threads on the closure and the number of threads on the container. The lug on the release element normally extends upwardly for engagement-with at least one of the stop lugs such that when the release element is pressed radially inwardly, the lug is disengaged from engagement with a stop and the closure can be removed by unthreading the closure from the container.

Among the objectives of the present invention are to provide a child resistant package which is consumer friendly; wherein the child resistant package is easy to apply and close; wherein the child resistant package requires a lesser force or torque when the closure is rotated to apply the closure to the container that is substantially less than the torque required to remove the closure from the container; wherein the child resistant package minimizes the wear on a locking lug during application of the closure to the container; wherein the child resistant package minimizes the deflection of the release element on the container when the closure is rotated to apply the closure to the container; wherein the child resistant package has a locking 5 lug which provides sufficient rigidity to resist removal of the closure without deflecting when a torque is applied in an attempt to remove the closure from the container without manipulating the release element; wherein the child resistant package includes provision for controlling the deflection of the release element on the container; and wherein the child resistant package makes it more likely that an older adult will fully apply the closure.

In accordance with the invention, a child resistant package includes a container having an open end with a single thread or multiple threads on the external surface of the container adjacent the upper end. A closure having a base wall and a peripheral skirt has an inner surface formed with single or multiple threads corresponding in number to the multiple threads on the container for engaging the threads on the container. A deflectable release element is formed integrally on the exterior surface of the container below the threads. The release element includes an integral axially deflectable lug extending upwardly toward the open end of the container. The closure has at least one locking lug on the inner surface of the skirt of the closure below the threads, the number of locking lugs preferably corresponding in number to the number of threads on the closure and container. The deflectable lug on the release element normally extends upwardly for engagement with the locking lug such that when the deflectable release element is pressed radially inwardly, the deflectable lug is disengaged from engagement with a locking lug and the closure can be removed by unthreading the closure from the closure. When the closure is reapplied minimal torque is required due to the axial deflection of the lug and the locking lug on the closure moves past the deflectable lug.

In a preferred form of the child resistant package, the deflectable release element includes means thereon which when deflected engages means on said container to limit the deflection on the deflectable release element in an axial direction. Such interengaging means comprises a pair of axial projections on the deflectable release element and a pair of stops on the container which are brought into engagement upon excessive deflection of the release element.

DESCRIPTION OF THE DRAWINGS

FIG. 7 is a fragmentary perspective view of the container.

FIG. 8 is a bottom view of the container.

FIG. 9 is an enlarged part sectional elevational view of the container.

FIG. 10 is a fragmentary view taken along the line 10—10 in FIG. 9.

FIG. 18 is a fragmentary top plan view of the container shown in FIG. 17.

FIG. 19 is a fragmentary elevational view of the upper part of the container shown in FIG. 17.

FIG. 20 is a fragmentary bottom plan view of a portion of the container shown in FIGS. 18 and 19.

FIG. 21 is a fragmentary sectional view taken along the line 21—21 in FIG. 18.

FIG. 22 is a fragmentary sectional view taken along the line 22—22 in FIG. 18.

FIG. 23 is a fragmentary sectional view taken along the line 23—23 in FIG. 18.

FIG. 24 is a fragmentary sectional view on an enlarged scale of a upper portion of the container at the circle 24 in FIG. 23.

DESCRIPTION OF THE PREFERRED EMBODIMENT

Figure 1:
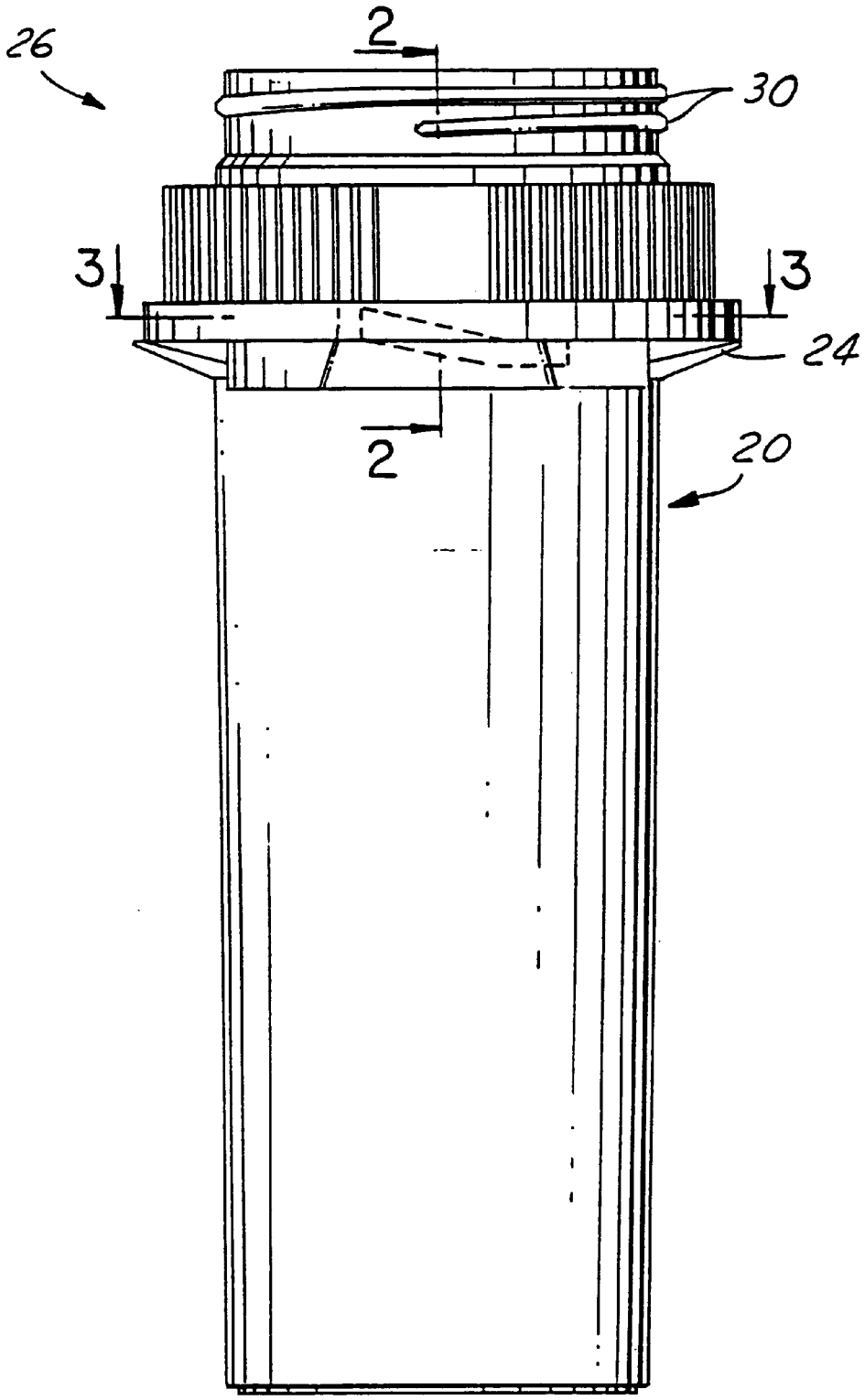
FIG. 1 is an elevational view on an enlarged scale of child resistant package embodying the invention.

Referring to FIGS. 1–12, the child resistant package comprises a cylindrical plastic container or vial 20 which has a single thread 22 adjacent its upper open end and a radial flange 24 below the single thread 22. The container 20 is adapted to receive a plastic closure 26. The closure 26 is preferably of a reversible type which has a cylindrical portion 28 which has an external thread 30 adapted to engage the internal thread 32 on the container 20 (FIG. 7) to close the container 20 when a non-child resistant mode of use is desirable.

The closure 26 also includes an annular radial flange 34 which extends from the base of the portion 28. An annular peripheral skirt 36 extends axially downwardly from the radial flange 34 and is concentric with the portion 28. A single internal thread 38 is formed on the internal surface of skirt 36 and engage thread 22 on the container 20.

The closure 26 includes a second annular skirt 40 extending axially downwardly from the lower end of the skirt 36 and connected thereto by a second annular radial flange 42 such that the skirt 40 is spaced from the thread 38. A single locking lug or stop 44 extends 1 5 radially inwardly from the inner surface of skirt 40. The number of locking lugs 44 preferably corresponds in number to the number of threads 22. Lug or stop 44 includes a flat radial surface 46 lying at a small acute angle to an axial radial plane preferably not greater than about 20 degrees, preferably about 10 degrees. Each locking lug 44 also includes a chamfered surface 45 at the leading end to facilitate application of the closure 26 as well as minimize wear on the locking lug 44.

Figure 2:
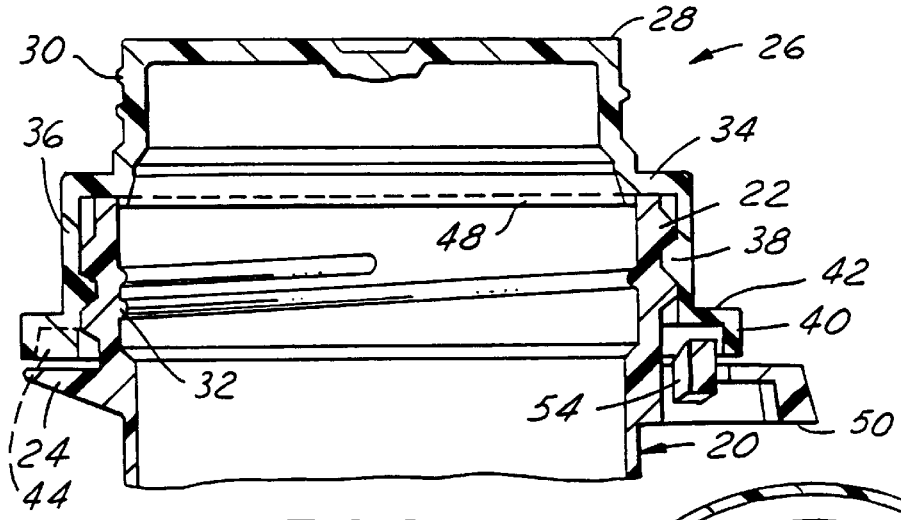
FIG. 2 is a fragmentary sectional view taken along the line 2—2 in FIG. 1 showing the closure on the container.
Figure 4:
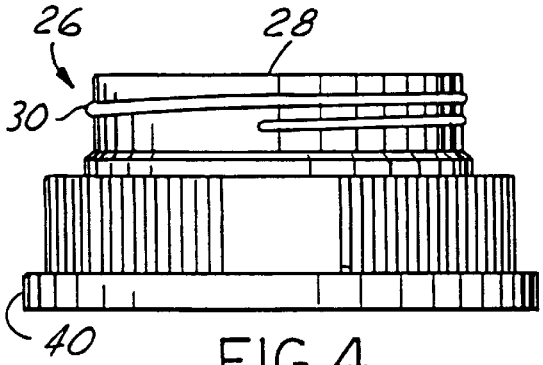
FIG. 4 is an elevational view of the closure.
Figure 3:
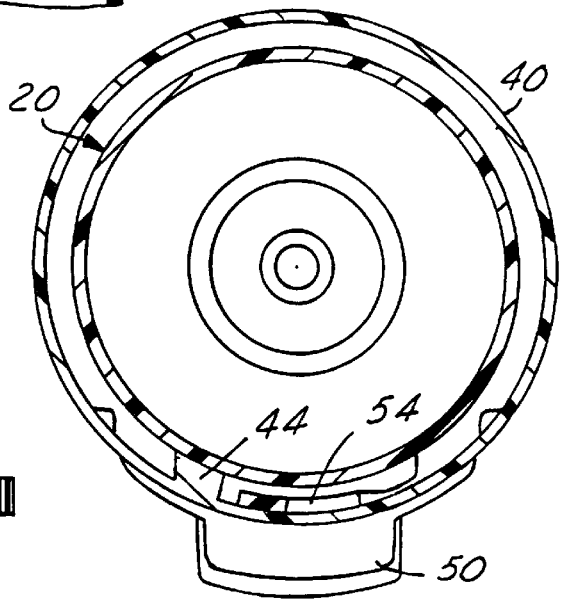
FIG. 3 is a sectional view taken along the line 3—3 in FIG. 1.
Figure 5:
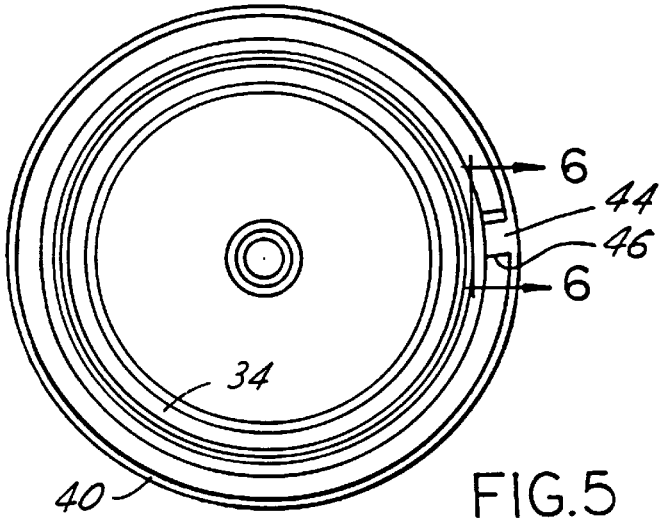
FIG. 5 is a bottom plan view of the closure.
Figure 6:
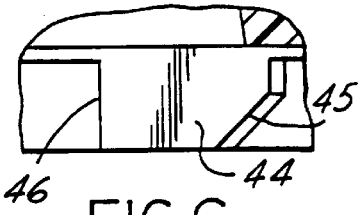
FIG. 6 is an enlarged fragmentary sectional view taken along the line 6—6 in FIG. 5.

The closure 26 may include an axial ring or plug portion 48 concentric with and spaced inwardly of skirt 36 and adapted to enter the mouth of the container 20 in spaced relation to the internal thread 32 when the cap is applied to the container as shown in FIG. 2. This forms seal on the interior of the container.

Referring to FIGS. 7 and 10, a deflectable tab or release element 50 is mounted on the vial 20 at an interruption or space in the flange 24. The release element 50 is connected to the vial 20 by circumferentially spaced horizontal flexible and resilient arms 52 which are attached to the vial 20 at one end and to the release element 50 at the other end such that the release element is spaced from the vial. The deflectable release element 50 has a radial width and axial thickness which is sufficient to make the element convenient for an adult to remove the closure from the container by depressing the element 50 yet difficult for a child to open the package. A single integral cantilever lug 54 extends axially upwardly from the release element 50. The cantilever lug 54 is axially deflectable upon the application of the closure and is mounted in a cantilever manner on the release element 50 and includes an axial stop surface 56 which is inclined at a small acute angle to an axial radial plane complementary to the angle of surface 46 on locking lug 44, preferably not greater than about 20 degrees, preferably about 10 degrees. Preferably, the cantilever lug 54 comprises a cantilever arm hinged to the release element 50 by an axial hinge 60 at the juncture of a resilient arm 52 and release element 50. Cantilever lug 54 extends circumferentially in the same direction as the direction of rotation of closure 26 when it is applied, herein shown as clockwise when viewed from the top. Cantilever lug 54 includes an end surface 56 that is intended to engage surface 46 on the locking lug 44 on the closure 26.

In application of the closure 26 to the container 20, the inclined surface 45 on lug 44 deflects the cantilever lug 54 with a minimum amount of wear on the locking lug 44. At the same time, the locking lug 44 remains sufficiently rigid to resist rotational stripping torque when any effort is made to remove the closure without deflecting the release element 50 such that there is no downward movement of the cantilever lug 54. The engagement of surfaces 46 and 56 functions to increase the rotational stripping force which may be applied to defeat the functioning of the package. When an increased torque is applied by a user in an effort to remove the closure without depressing the release element 50, the engagement of the surfaces 46 and 56 forces the free end of the cantilever lug 54 into the juncture of the locking lug 44 with the radial flange 42.

Figure 11:
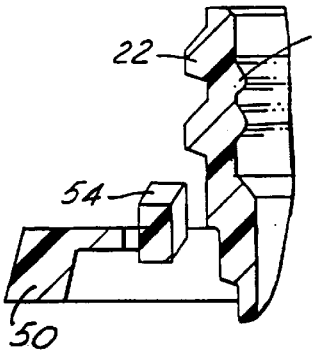
FIG. 11 is a fragmentary sectional view on an enlarged scale taken along the line 11—11 in FIG. 10.
Figure 12:
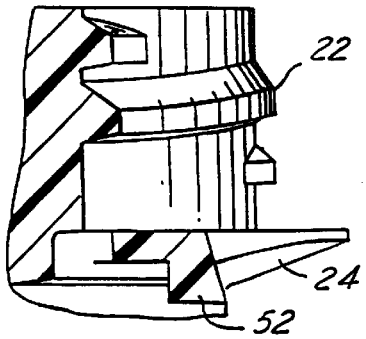
FIG. 12 is a fragmentary sectional view on an enlarged scale taken along the line 12—12 in FIG. 10.

When it is desired to remove the closure 26, the release element 50 responds to thumb or finger pressure applied radially of the closure 26 and the container 20 such that the connecting arms 52 bend and the release element 50 swings radially inwardly and downwardly to separate the single cantilever lug 54 on the release element 50 out of interlocking engagement with a locking lug 44 on the closure 26 as the closure is rotated counterclockwise for removal. Preferably, arms 52 are L-shaped in axial cross section as shown in FIGS. 11 and 12 to provide controlled deflection.

When it is desired to use the package in a non-child resistant mode, the closure 26 may be inverted and the external thread 30 on the closure is engaged with the internal thread 32 on the container.

The plastic container 20 is preferably made of homopolymer polypropylene and the closure 26 is preferably made of high density polyethylene. Other container materials which can be used, depending on the nature of the contents, such as copolymer polypropylene, other polyethylenes, and PET. Other closure materials may also be used depending on the nature of the contents of the containers.

Figure 13:
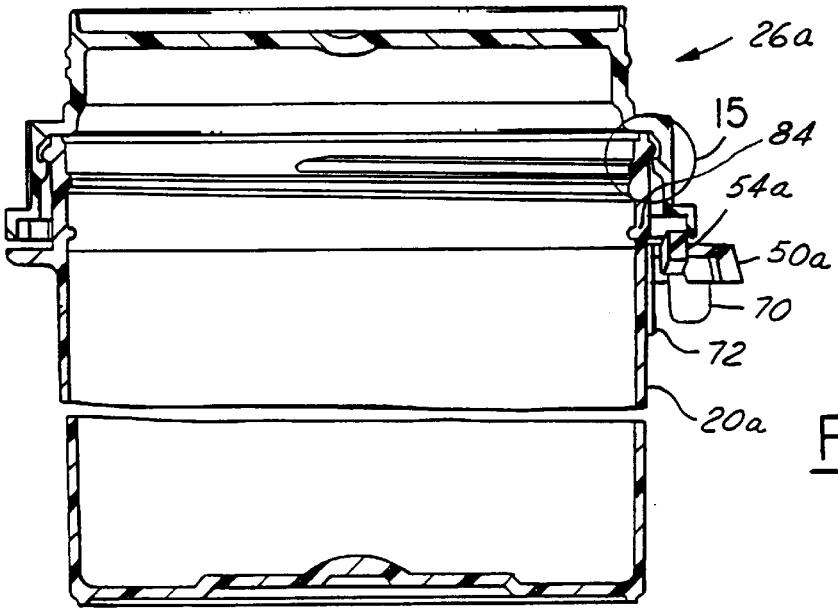
FIG. 13 is vertical sectional view of a modified form of package.
Figure 14:
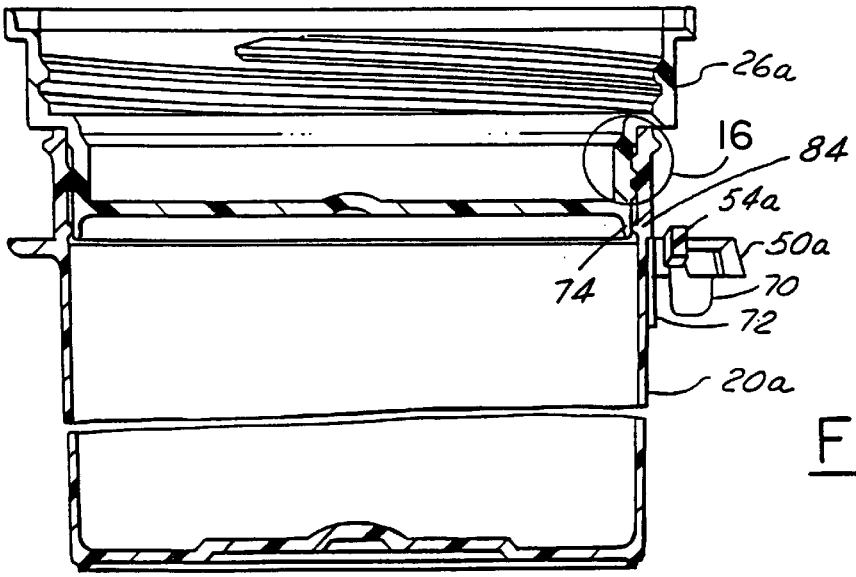
FIG. 14 is a vertical sectional view of the package shown in FIG. 13 with the closure shown in a non-child resistant mode.
Figure 15:
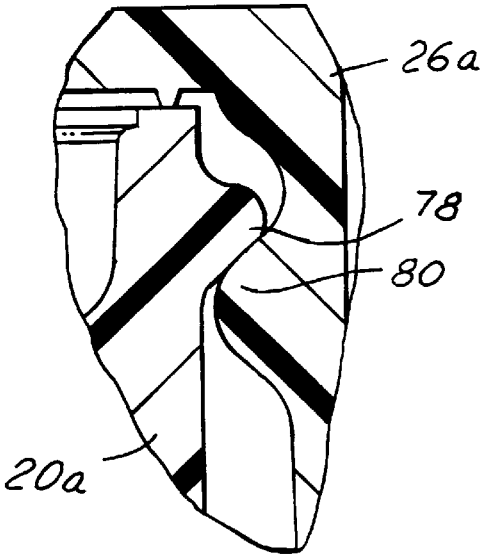
FIG. 15 is a fragmentary view on an enlarged scale of a portion at the circle 15 in FIG. 13.
Figure 16:
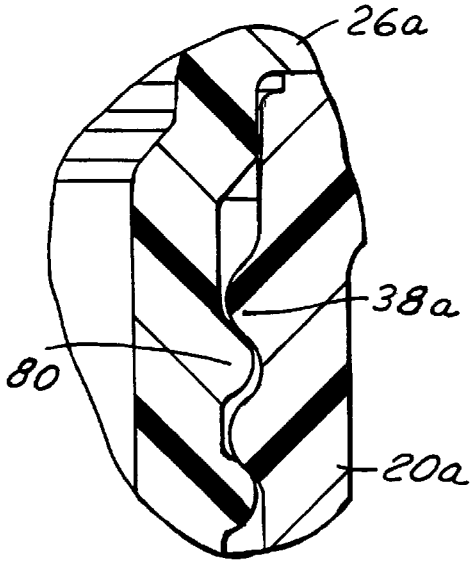
FIG. 16 is a fragmentary enlarged view of a portion at the circle 16 in FIG. 14.

FIGS. 13–30 are directed to a modified form of child resistant package. The package is substantially the same, corresponding parts being marked with a suffix "a". In this form, the package includes means for preventing the tab from deflecting excessively such that it would be overstressed and exceed the yield point of the plastic material and potentially create unacceptable plastic deformation. FIG. 13 shows the assembled package in a child resistant mode and FIG. 14 shows the package with the closure in a non-child resistant mode.

Figure 17:
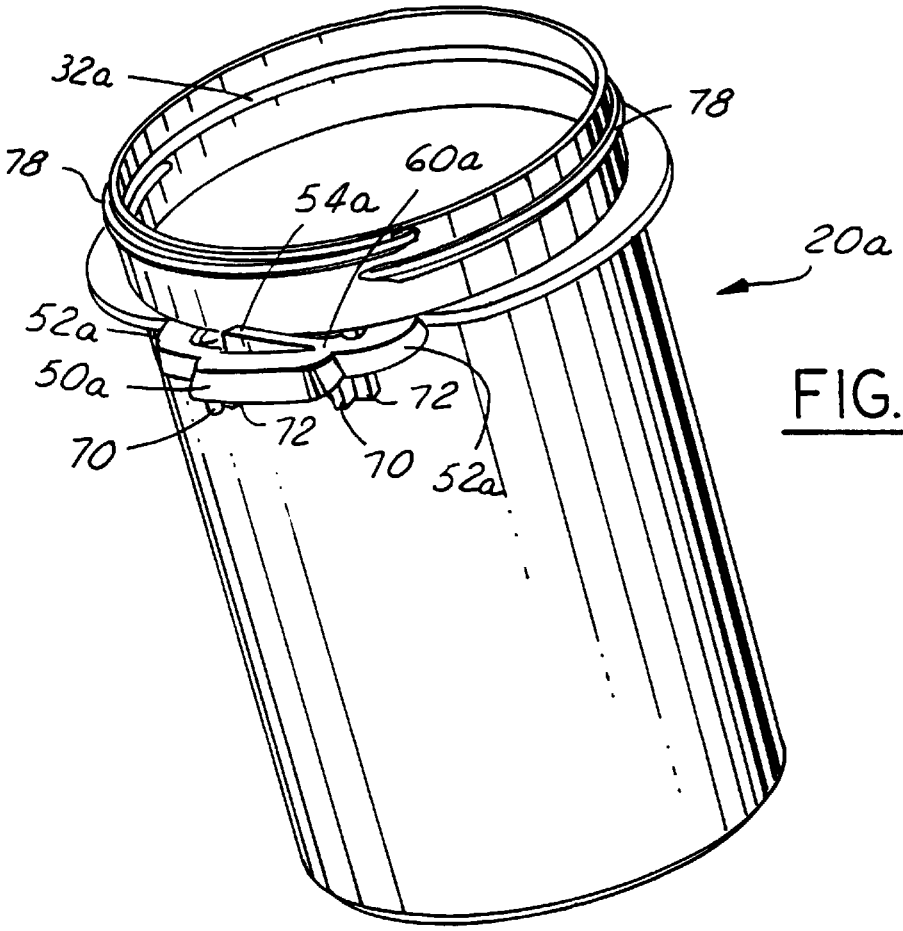
FIG. 17 is a perspective view of a modified form of container.
Figure 25:
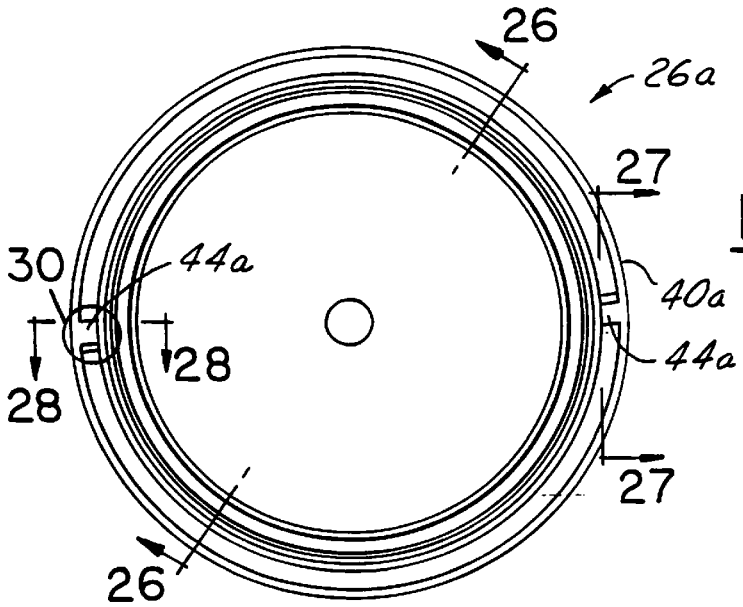
FIG. 25 is a bottom plan view of a closure utilized with the container shown in FIGS. 17–24.
Figure 30:
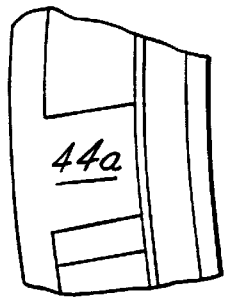
FIG. 30 is a sectional view on an enlarged scale taken along the circle 30 in FIG. 25.
Figure 26:
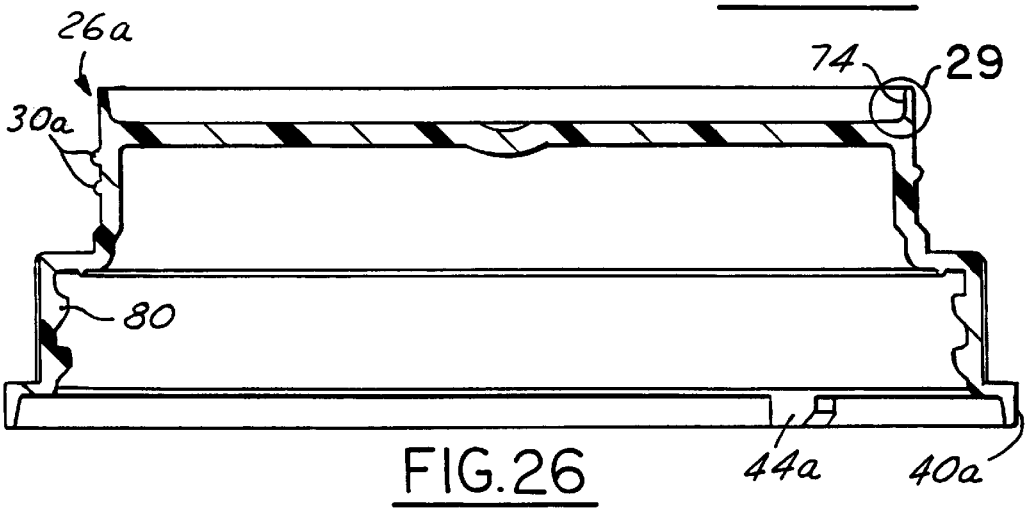
FIG. 26 is a sectional view taken along the line 26—26 in FIG. 25.
Figure 27:
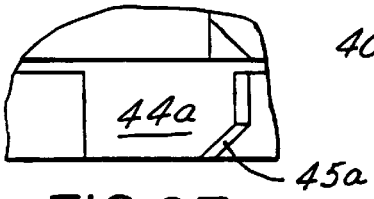
FIG. 27 is a fragmentary sectional view taken along the line 27—27 in FIG. 25.
Figure 28:
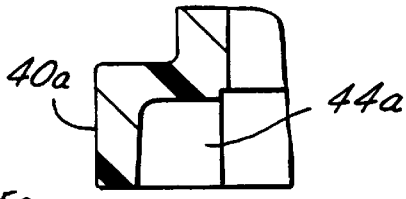
FIG. 28 is a fragmentary sectional view on an enlarged scale taken along the line 28—28 in FIG. 25.

Referring to FIG. 17, the container 20*a* includes positive stop means to control the deflection of loading deflectable release element 50*a*. This means comprises a pair of circumferentially spaced tab feet 70 and tab stops 72. Tab feet 70 extend downwardly axially along resilient arms 52*a* and deformable release element 50*a,* and are molded integrally therewith. Tab stops 72 extend axially from the side wall of vial 20*a* and are molded integrally thereon. When the closure 26*a* is fully applied on the container 20*a*, the lower ends of tab feet 70 are radially aligned and spaced radially from the tab stops 72 (FIGS. 13, 14). When the release element 50*a* is deflected the locking lug 54*a* is moved out of engagement with the stop 44*a* on the closure 26*a*. However, if excessive force is used, then the tab feet 70 will engage the tab stops 72 and prevent the movement of the release element 50*a* further than necessary to disengage the cantilever lug 54*a* and excessive deflection of the release element 50*a*.

This form of child resistant package also differs in that it uses multiple threads, herein shown as double threads 78 on the container instead of a single thread 22 as in FIGS. 1–12.

Figure 29:
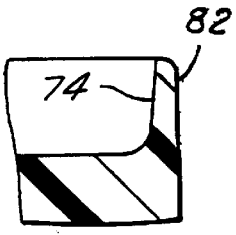
FIG. 29 is a fragmentary sectional view on an enlarged scale at the circle 29 in FIG. 26.
Figure 31:
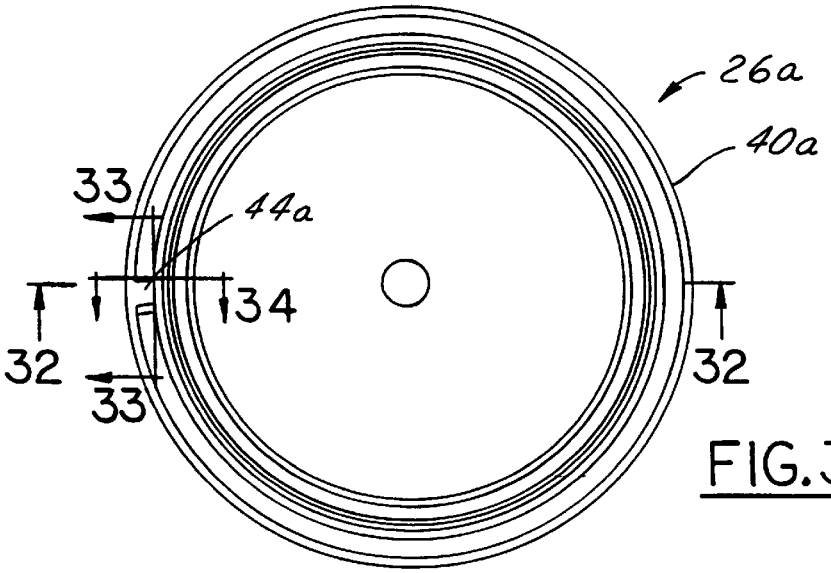
FIG. 31 is a bottom plan view of a modified form of closure.
Figure 32:
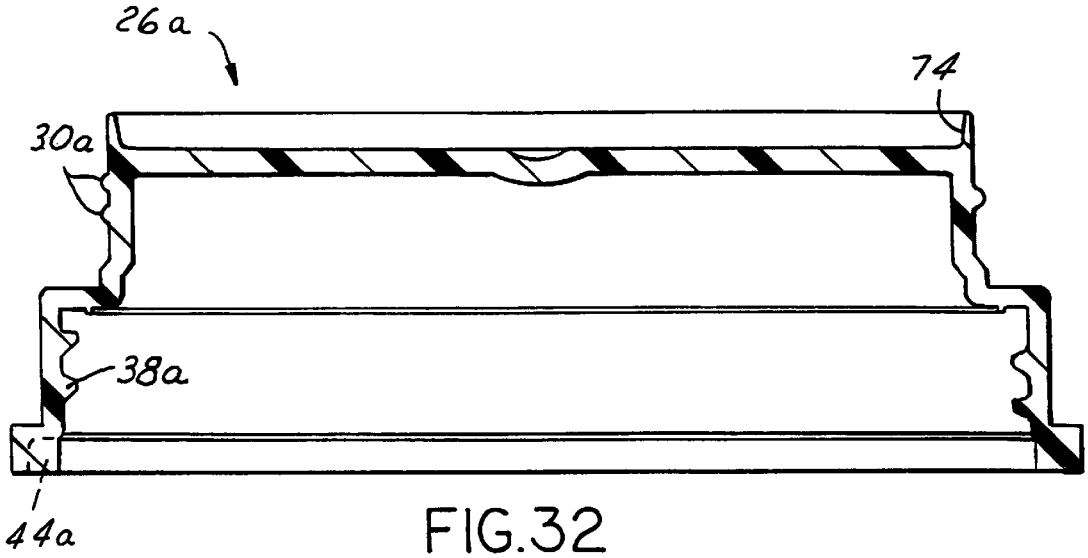
FIG. 32 is a fragmentary sectional view taken along the line 32—32 in FIG. 31.
Figure 33:
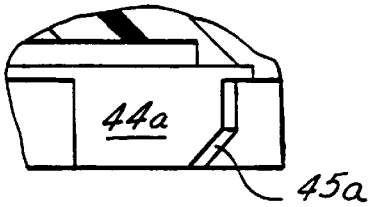
FIG. 33 is a fragmentary sectional view taken along the line 33—33 in FIG. 31.
Figure 34:
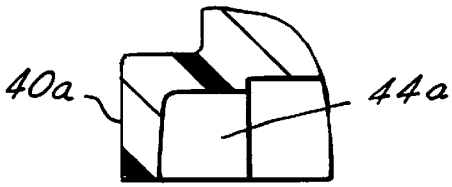
FIG. 34 is a fragmentary sectional view taken along the line 34—34 in FIG. 3 1.

The closure 26*a* has complementary double threads 80. In addition, as shown in FIG. 29, a tapered flexible surface 82 is applied to the axial wall 74 with external threads 30*a* which facilitates reversal of the closure 26*a* so that it will provide a seal against bead 84 used in a non-child resistant mode as shown in FIG. 14. The closure 26*a* is molded using a mold insert such that there is no parting line on the tapered flexible surface 82 such that an improved seal is achieved.

The modified form of closure shown in FIGS. 30–34 is similar to that shown in FIGS. 25–29 except that it has a single thread 38*a*, as in FIGS. 1–12.

Figure 35:
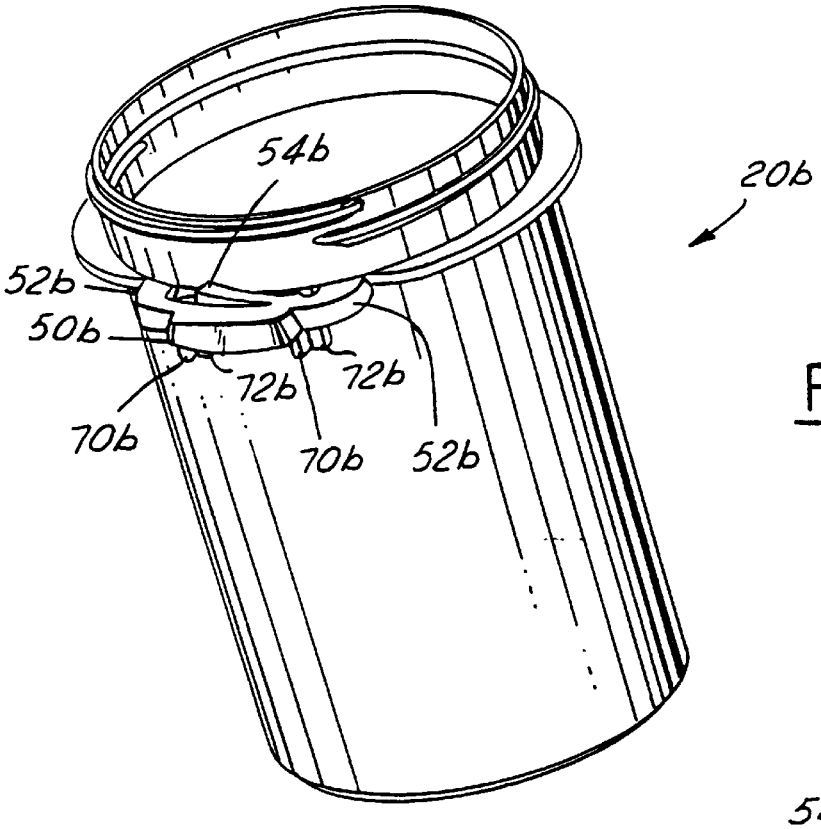
FIG. 35 is a perspective view of a further modified form of container.
Figure 36:
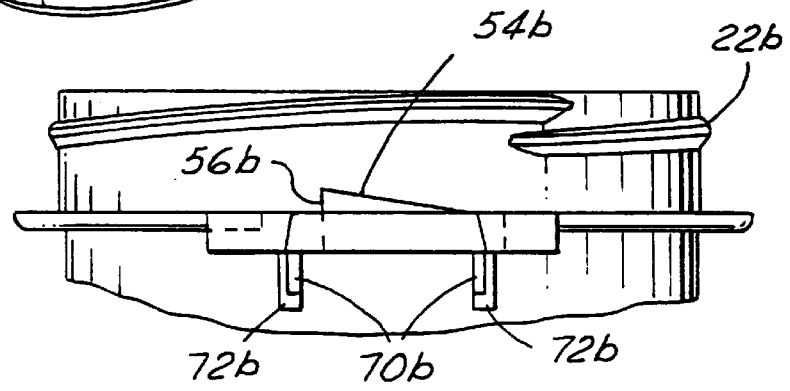
FIG. 36 is an fragmentary elevational view of the container shown in FIG. 35.

The stop means described above with respect to FIGS. 17–34 is also applicable to the aforementioned U.S. Pat. No. 4,306,385 and application Ser. No. 08/608,877, incorporated herein by reference. As shown in FIGS. 35 and 36, the rigid lug 54*b* is an integral part of the deflectable release element 50*b*. The container 20*b* includes the positive stop means to control deflection of the deflectable release element 50*b* and includes the tab feet 70*b* and tab stops 72*b*. The container and closure have a single thread. In all other respects, the child resistant package may be like the package of the aforementioned U.S. Pat. No. 4,306,385 and patent application Ser. No. 08/608,877.

Although the invention has been described in connection with use on a container that comprises a vial, it is applicable to containers wherein the container has a threaded finish as shown, for example, in U.S. Pat. Nos. 4,427,124, 4,948,002 and 5,413,233, incorporated herein by reference.

It can thus be seen that there has been provided a child resistant package which is consumer friendly; wherein the child resistant package is easy to apply and close; wherein the child resistant package requires a lesser force or torque when the closure is rotated to apply the closure to the container that is substantially less than the torque required to remove the closure from the container; wherein the child resistant package minimizes the wear on a locking lug during application of the closure to the container; wherein the child resistant package minimizes the deflection of the release element on the container when the closure is rotated to apply the closure to the container; wherein the child resistant package has a locking lug which provides sufficient rigidity to resist removal of the closure without deflecting when a torque is applied in an attempt to remove the closure from the container without manipulating the release element; wherein the child resistant package includes provision for controlling the deflection of the release element on the container; and wherein the child resistant package makes it more likely that an older adult will fully apply the closure.

We claim:

1. A child resistant package comprising a plastic container having an open end, thread means on the external surface of the container adjacent the open end for securing a closure, a plastic closure having a peripheral skirt, said skirt having an inner surface formed with thread means for engaging the thread means on the container, a deflectable release element formed integrally on the exterior surface of the container and mounted on said container for radial and axial movement relative to said container, a lug mounted on said release element and extending upwardly toward the open end of the container, and stop means between said deflectable release element and said container exterior surface, said stop means being spaced from each other when said deflectable release element is undeflected toward the container exterior surface and being brought into abutment when said deflectable release element is deflected toward said container exterior surface for limiting deflection of said release element toward said container exterior surface and away from said open end.

2. The child resistant package set forth in claim 1 wherein stop means comprise at least one tab foot on said deflective release element and at least one tab stop on the container.

3. The child resistant package set forth in claim 2 wherein said at least one tab foot includes an axial projection on said release element.

4. The child resistant package set forth in claim 2 wherein said at least one tab stop includes an axial projection on said container.

5. The child resistant package set forth in claim 2 wherein said at least one tab foot includes an axial projection to said release element and said at least one tab stop includes an axial projection on said container.

6. The child resistant package set forth in claim 2 wherein said at least one tab foot comprises a pair of circumferentially spaced axially extending tab feet on said deflectable release element, and said at least one tab stop comprises a pair of axially extending stops on said container, said feet and said stops being normally radially aligned and spaced from one another.

7. A plastic container for use in a child resistant package including a plastic closure having a peripheral skirt with threads on said skirt and a lug on said skirt, said plastic container having an open end, thread means on the external surface of the container adjacent to the open end for securing a closure, a deflectable release element formed integrally on the exterior surface of the container, a lug mounted on said release element extending upwardly toward the open end of the container for engagement with a lug on a closure when the closure is applied to the container, said release element being mounted on said container for radial and axial movement relative to said container, and stop means between said deflectable release element and said container exterior surface, said stop means being spaced from each other when said deflectable release element is undeflected toward the container exterior surface and being brought into abutment when said deflectable release element is deflected toward said container exterior surface for limiting deflection of said release element toward said container exterior surface and away from said open end.

8. The plastic container set forth in claim 7 wherein said means between said deflectable release element and said container comprise stop means on the container for limiting deflection of said deflectable release element.

9. The plastic container set forth in claim 8 wherein stop means comprises at least one tab foot on said deflectable release element.

10. The plastic container set forth in claim 9 wherein said at least one tab foot includes an axial projection to said release element.

11. The plastic container set forth in claim 9 wherein said tab stop means includes an axial projection on said container.

12. The plastic container set forth in claim 8 wherein said stop means comprises at least one tab foot includes an axial projection on said release element and an axial projection on said container.

13. The plastic container set forth in claim 12 wherein said stop means comprises a pair of circumferentially spaced axially extending tab feet on said deflectable release element and tab stop feet on the container which are normally radially aligned and spaced from one another.

* * * * *